US009381924B2

(12) United States Patent
Dumortier

(10) Patent No.: US 9,381,924 B2
(45) Date of Patent: Jul. 5, 2016

(54) DOUBLE-DECKER RAILWAY ROLLING STOCK VEHICLE WITH PATHS TO THE UPPER DECK

(71) Applicant: SNCF Mobilités, Saint-Denis (FR)

(72) Inventor: Robert Dumortier, Le Mans (FR)

(73) Assignee: SNCF Mobilités, Saint-Denis (FR)

( * ) Notice: Subject to any disclaimer, the term of this patent is extended or adjusted under 35 U.S.C. 154(b) by 43 days.

(21) Appl. No.: 13/749,238

(22) Filed: Jan. 24, 2013

(65) Prior Publication Data

US 2013/0186299 A1 Jul. 25, 2013

(30) Foreign Application Priority Data

Jan. 25, 2012 (FR) ..... 12 50731

(51) Int. Cl.
*B61D 1/06* (2006.01)

(52) U.S. Cl.
CPC ..... *B61D 1/06* (2013.01)

(58) Field of Classification Search
CPC ..... B61D 1/06
USPC ..... 105/340
See application file for complete search history.

(56) References Cited

U.S. PATENT DOCUMENTS

| | | | | |
|---|---|---|---|---|
| 1,196,568 | A * | 8/1916 | MacFadden | 105/340 |
| 2,811,932 | A | 11/1957 | Clary | |
| 3,892,188 | A * | 7/1975 | Warren | 410/28 |
| 2009/0238009 | A1 * | 9/2009 | Gatzemeier et al. | 365/189.02 |

FOREIGN PATENT DOCUMENTS

| | | | | |
|---|---|---|---|---|
| DE | 4120590 | A1 | 12/1992 | |
| DE | 102005002701 | A1 | 7/2006 | |
| EP | 0616935 | * | 3/1994 | B61D 1/06 |
| EP | 0 631 917 | A1 | 1/1995 | |
| EP | 2030860 | A1 | 3/2009 | |
| FR | 2859967 | A1 | 3/2005 | |

OTHER PUBLICATIONS

Preliminary Search Report dated Oct. 10, 2012 from corresponding French Application No. 1250731 (2 pages).

Written Opinion dated Oct. 10, 2012 from corresponding French Application No. 1250731 (3 pages).

European Search Report from European Patent Office on corresponding EP application (EP 14150207.0) dated Apr. 17, 2014.

* cited by examiner

*Primary Examiner* — Zachary Kuhfuss

(74) *Attorney, Agent, or Firm* — Klein, O'Neill & Singh, LLP

(57) ABSTRACT

Exemplary double-decker vehicle for railway rolling stock for the transport of passengers comprises at least:

one lower deck and one upper deck, each deck having a multiplicity of seats for passengers, and at least one access door with an access step.

According to aspects of the system, apparatus, and method, the vehicle can include, among other features, a circulation system connecting the access step to the upper deck and having at least two sloping circulation paths to provide access for persons with reduced mobility to the upper deck.

17 Claims, 5 Drawing Sheets

DOUBLE-DECKER RAILWAY ROLLING STOCK VEHICLE WITH PATHS TO THE UPPER DECK

FIELD OF ART

The system, apparatus, and method disclosed herein concern the field of passenger transport by rail, and especially universal access, including for persons with reduced mobility, to a double-decker railway rolling stock vehicle, for instance a high speed train.

BACKGROUND

Traditionally, a train for passenger transport comprises a multiplicity of vehicles linked together. Each vehicle comprises a deck on which are installed a multiplicity of seats for the comfort of travelers. To increase the number of passengers able to be housed in a vehicle the concept is known, in existing technology, of a vehicle with two levels, vertically, comprising an upper and lower deck, each containing a multiplicity of seats. Such a double-decker vehicle is known by the person skilled in the art as a "duplex" vehicle.

A double-decker vehicle traditionally comprises an access door by which the passengers can enter the vehicle. The access door step is conventionally situated at an intermediate height between the lower and the upper decks of the double-decker vehicle. Staircases are provided between the step and the lower deck and between the step and the upper deck.

The presence of staircases is a major inconvenience for persons with reduced mobility because they constitute an obstacle to be passed (risk of falling, etc). By a person with reduced mobility we mean a person in a wheelchair or a person with a handicap (motor, visual, etc,) or a person with large or heavy pieces of luggage. Besides their worrisome nature for persons with reduced mobility, staircases have a limited life because of wear of the leading edge of the steps; this is also a disadvantage. Because of their steep angle, staircases require an excessive physical effort from passengers; this is a disadvantage. In addition, moving items of luggage in staircases is inconvenient.

An immediate solution to eliminate staircases would be to abandon double-decker vehicles and use only single-decker vehicles, but this solution is not economically viable. Another solution would be to add lifting platforms or elevators inside the vehicle. Even if we ignore the high cost of this solution, it greatly reduces the space available inside the vehicle, which is not desirable.

SUMMARY

The system, apparatus, and method of the present disclosure aim to overcome the disadvantages. The double-decker railway rolling stock vehicle for the transport of passengers that it concerns comprises traditionally:

- at least one lower deck and one upper deck, each deck containing a multiplicity of seats for passengers, and
- at least one access door with a step.

According to aspects of the invention, which comprise system, apparatus, and method for implementing the disclosed embodiments, the vehicle contains a circulation system connecting the access step to the upper deck and comprising at least two sloping circulation paths.

Henceforth, by sloping circulation paths we mean a staircase or a slope or inclined plane.

With advantage, persons with reduced mobility can reach the upper deck of the vehicle without fear and without inconvenience. The use of at least two sloping circulation paths enables their angle to be limited, consequentially facilitating the ascent and descent of persons with reduced mobility.

Preferably, the inclination of the circulation paths is opposed so as to reduce the space occupied by the upper circulation system in the vehicle. Preferably, the circulation systems are adjacent to each other. Hence the passenger capacity of the vehicle is not affected by the use of sloping paths. With advantage, the upper circulation system is formed in the same place as the staircases used in existing technology so as not to reduce the service or comfort offered by a vehicle using existing technology.

According to a preferred aspect of the system, apparatus, and method, the first circulation path joins the access step to an intermediate landing and the second circulation path connects the intermediate landing to the upper deck. In this way the intermediate landing serves to provide the transition between the two circulation paths to access the upper deck. The intermediate landing should preferably be horizontal to facilitate, for example, the orientation of a wheelchair between the circulation paths.

The upper circulation system should preferably comprise a first circulation path, an intermediate landing and a circulation path.

Its again preferable that the intermediate landing be situated at the longitudinal extremity of the vehicle. Its again preferable that the intermediate landing be situated at a vertical height between that of the lower deck and that of the upper deck. It is also preferable that the vehicle possess a communication corridor to another vehicle accessible from the intermediate landing.

According to another aspect of the present disclosure, the access step is situated at one end of a sloping circulation path of the upper circulation system. It is preferable that the access step be situated approximately in the centre of the vehicle. The access door and the access step are advantageously placed in the centre to enable the upper circulation system to extend on one side of the vehicle only in order to reduce the area it occupies. It is evident that the access door could be placed at various positions in the vehicle depending on the configuration of the rolling stock, to facilitate the layout (access to seats for persons in wheelchairs, etc). In addition, the access step is a quiet zone in comparison with prior art considering that it is distant from the ends of the vehicle and hence from the bogies which cause noise nuisance. Hence, a passenger can telephone from the access step in better acoustic conditions.

The sloping circulation paths should have an inclination angle between 8% and 15%, preferably less than 12%. A circulation path with an inclination angle of less than 8% requires an excessive amount of space, whilst a circulation path with an angle above 15% is too steep to be climbed or descended by a person with reduced mobility. For the fitting out of spaces used by persons in wheelchairs, the slope is less than 8% and preferably less than 6%. It is preferable for a circulation system to comprise several successive portions with different angles.

It is again preferable that the sloping circulation systems have a width of between 55 cm and 75 cm. Such circulation systems allow easy movement for persons with reduced mobility without excessively limiting the space available for passengers in the vehicle. It is preferable for a circulation system to have a widened section to enable two persons with reduced mobility to pass each other in opposite directions. This width is preferably increased between 80 and 100 cm for the sections accessible by wheelchair. It is also preferable that sloping circulation paths have a length of between 6 m and 10 m.

It is again preferable that the vehicle has at one longitudinal extremity an upper communication corridor for accessing another vehicle and, at its other longitudinal extremity an intermediate communication corridor for accessing another vehicle. In other words, the vehicle is not symmetrical lengthwise: to enable a person with reduced mobility to access another vehicle without using a staircase.

It is again preferable that the vehicle include a free space for technical requirements or service to passengers, notably luggage space, situated under the second circulation path of the upper circulation system. Hence the upper circulation system fulfils a dual function by enabling luggage to be deposited and thus enabling seats to be installed in place of the luggage compartments situated on the upper and lower decks.

Preferably the circulation paths are in the form of staircases and/or circulation slopes. Hence, for example a first circulation path may be in the form of a slope while the second circulation path is in the form of staircases. This favours the movement of persons with reduced mobility between vehicles when the communication corridors are joined by intermediate landings situated at the longitudinal extremities of the vehicle.

Preferably, circulation paths are in the form of circulation slopes. In other words, the circulation system joining the access step to the upper deck comprises at least two circulation slopes. Circulation slopes, that is inclined planes, present better safety for passengers as the risk of falling is small. Moreover, a circulation slope is not greatly subject to wear; consequently the service life of rolling stock is increased. The presence of circulation slopes also enables a food and drinks trolley to circulate at all levels of the vehicle, thus improving service to passengers. Finally circulation slopes enable the passenger capacity to be increased when passengers wish to leave the vehicle. Passengers who are not leaving at the next station are protected from noise caused by other passengers leaving.

The system, apparatus, and method also concern a train containing at least one vehicle as previously described.

BRIEF DESCRIPTION OF THE DRAWINGS

The system, apparatus, and method will be better understood on reading the following description, given solely as an example, and by referring to the attached drawings on which.

DETAILED DESCRIPTION

It should be noted that the figures show the system, apparatus, and method in a detailed manner for implementation of the system, apparatus, and method; naturally the said figures can be used to better define the system, apparatus, and method if required.

Figure 1:
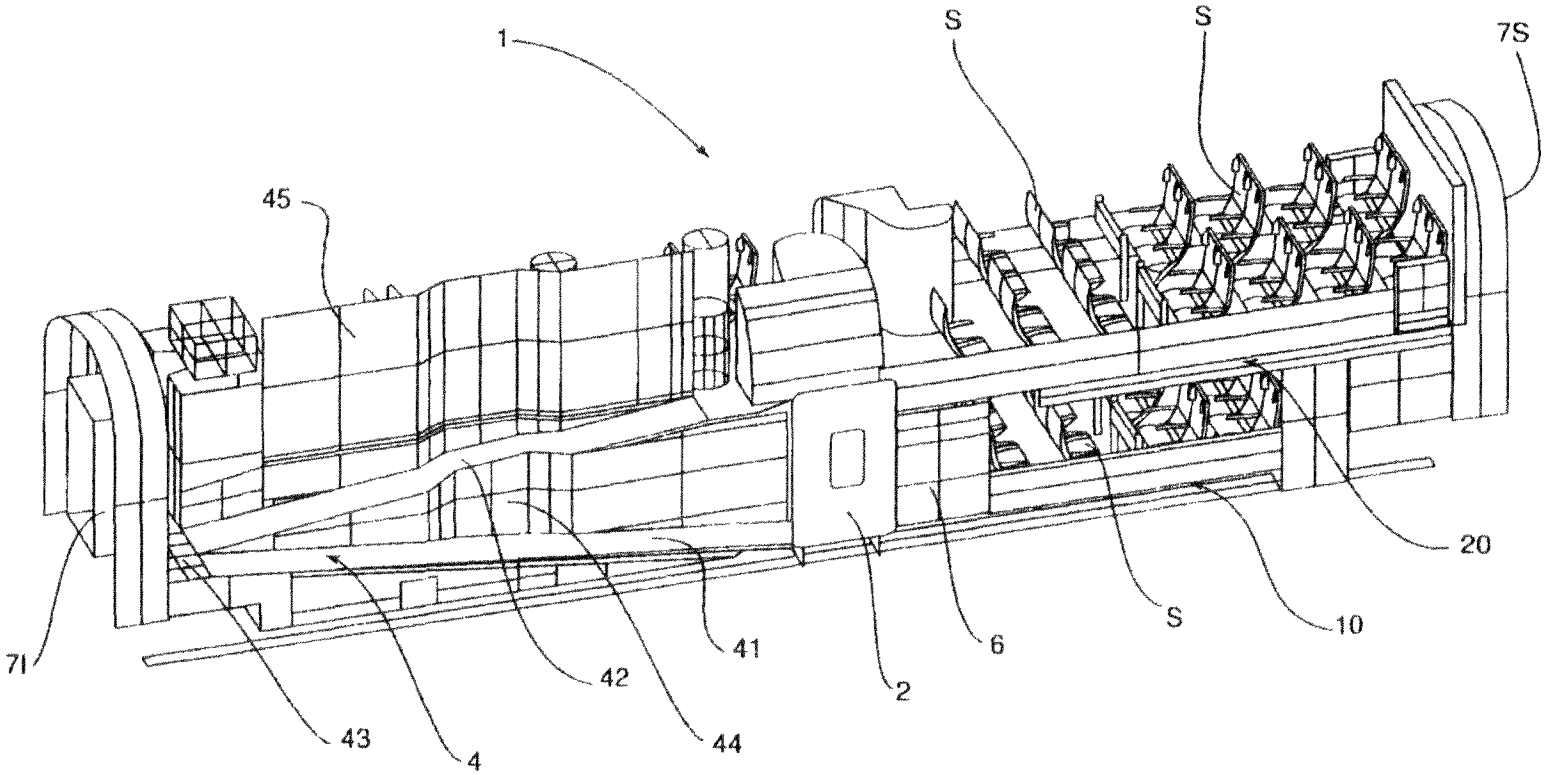
FIG. 1 is a schematic perspective view of a double-decker railway rolling stock vehicle for the transport of passengers with circulation slopes, according to the system, apparatus, and method.

FIG. 1 represents a double-decker rolling stock vehicle 1 for the transport of passengers, according to the system, apparatus, and method. The vehicle 1 is globally in the form of a parallelepiped and has side panels 6, which are traditionally fitted with windows. As shown in FIG. 1, the vehicle comprises a lower deck 10 and an upper deck 20 which each extend horizontally more or less over the whole length of the vehicle 1. The upper deck 20 is situated vertically above the lower deck 10 to form a "duplex" vehicle. Each deck, the lower 10 and the upper 20, comprises a multiplicity of seats S for the comfort of the passengers, which are laid out in the lateral rows spaced according to the length of the vehicle 1.

Figure 4:
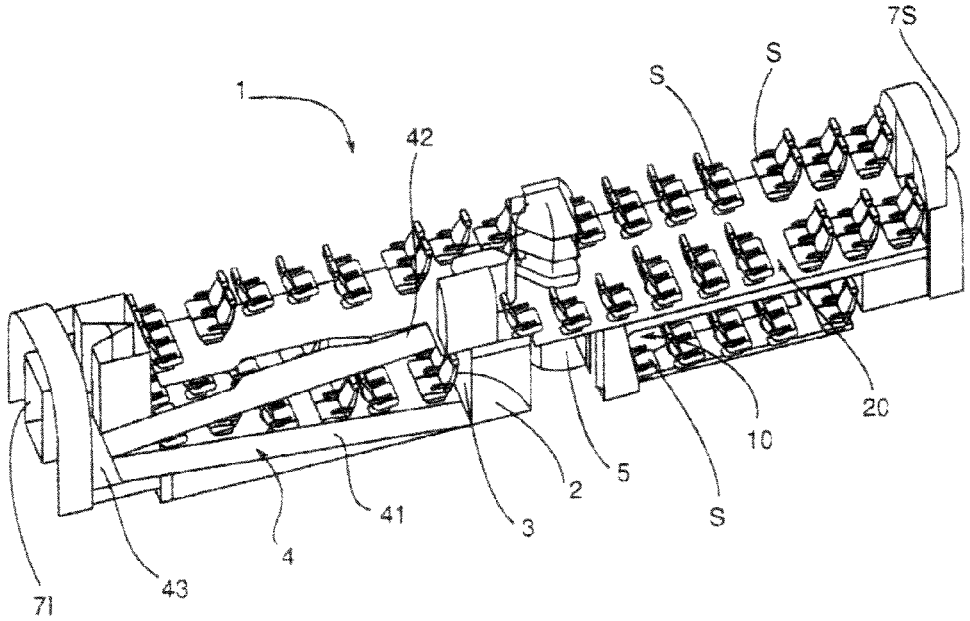
FIG. 4 is a schematic perspective view of a double-decker railway rolling stock vehicle for the transport of passengers with circulation slopes, according to the system, apparatus, and method.

In reference to FIGS. 1 and 4, each side panel 6 of the vehicle 1 comprises at least one access door 2 with an access step 3 to allow a passenger to enter the vehicle 1 from a station platform. As shown in FIG. 4. the access step 3 is in the centre of the vehicle that is in the middle of the vehicle 1 considered lengthwise. Thus, when a passenger enters the vehicle 1 from access door 2, he/she is first positioned on the access step 3 before accessing the lower deck 10 or the upper deck 20 to reach his/her seat S.

In this example, the vehicle 1 comprises an upper circulation system 4 which joins the access step 3 to the upper deck 20 and a lower circulation system 5 which joins the access step 3 to the lower deck 10.

Figure 2:
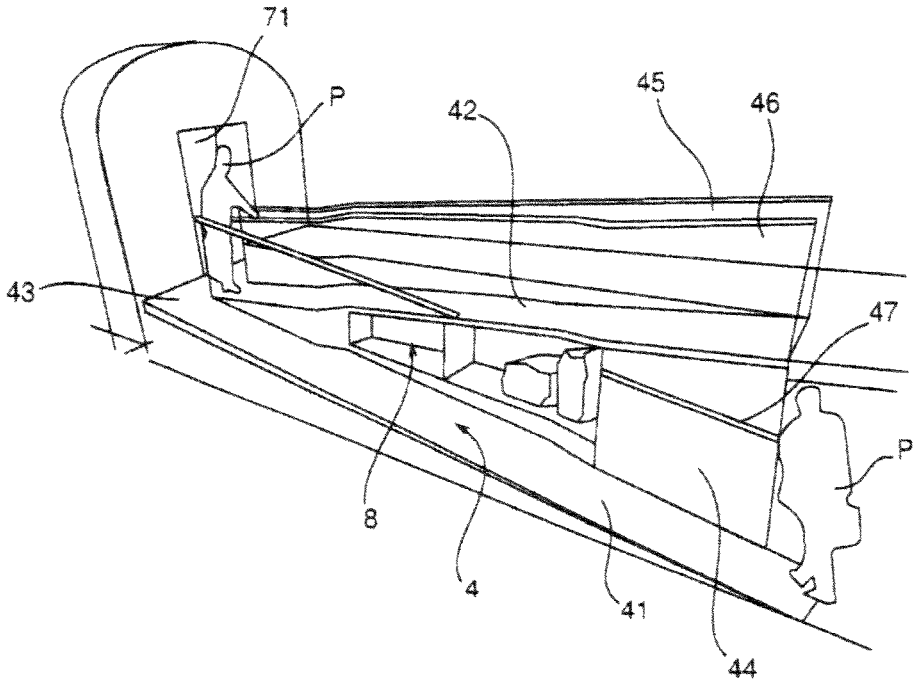
FIG. 2 is a simplified draught of the circulation slopes of a vehicle.
Figure 3:
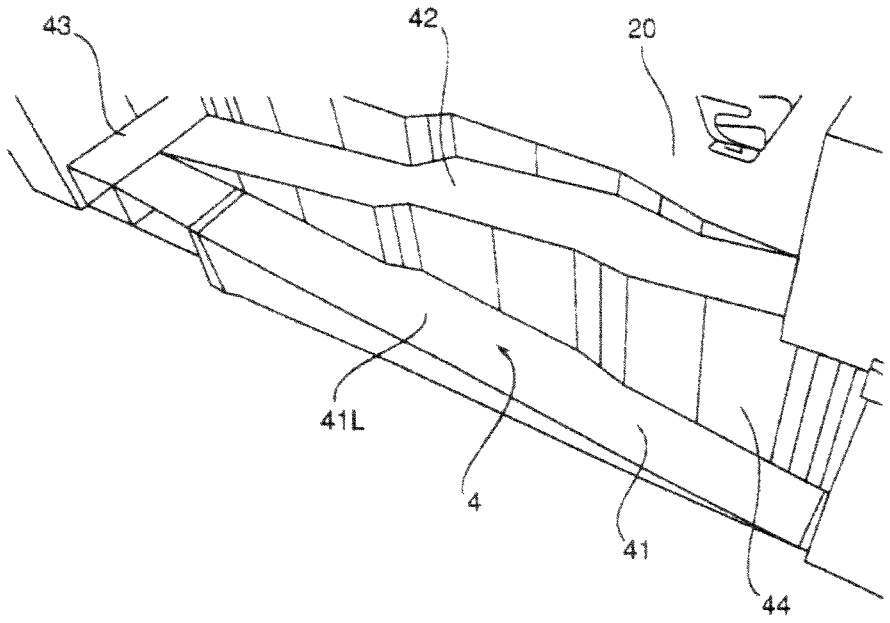
FIG. 3 is a schematic view of the circulation slopes of a vehicle.

According to the system, apparatus, and method of the present disclosure, in reference to FIGS. 1 to 3, the upper circulation system 4 comprises a first sloping circulation path 41, an intermediate landing 43 and a second sloping circulation path 42. In this example of execution, circulation paths 41 and 42 are in the form of circulation slopes, but naturally they could be in the form of two staircases, two slopes or a staircase and a slope.

In this example, still referring to FIGS. 1 to 3, the intermediate landing 43 is in the form of a horizontal platform providing the transition between the first sloping circulation slope 41 and the second sloping circulation slope 42. As shown in FIG. 1, the intermediate landing 43 is situated at one longitudinal extremity of the vehicle 1 and at a vertical height between that of the lower deck 10 and the upper deck 20.

The first sloping circulation slope 41 connects the access step 3 to the intermediate landing 43 whilst the second sloping circulation slope 42 connects the intermediate landing 43 to the upper deck 20. The first circulation slope 41 extends immediately next to the side panel 6 of the vehicle 1 in which the access door 2 is installed. In other words, after having passed through the access door 2 the first circulation slope 41 is directly accessible for the passenger. As represented in FIG. 1, the second circulation slope 42 is positioned next to the first circulation slope 41, circulation slopes 41 and 42 being adjacent in order to form a compact upper circulation system 4. Preferably, the second circulation slope 42 arrives on the upper deck 20 in the centre of the vehicle 1 directly above the access step 3.

The first circulation slope 41 and the second circulation slope 42 have slopes between 8% and 15%, preferably less than 12% to achieve a compromise in order to, on the one hand facilitate the movement of passengers, including reduced mobility persons, on the circulation slopes 41, 42 (low percentage slope), and on the other hand, limit the length of the circulation slopes 41, 42 (high percentage slope).

Preferably, the circulation slopes 41 and 42 have widths between 55 and 75 centimetres (excluding passing places for wheelchair passengers) to facilitate the circulation of people with large pieces of luggage or pushchairs. Preferably, as illustrated in FIG. 3, a circulation slope 41 and 42 may include a widened portion 41L, between 80 and 100 cm wide, to facilitate the passing of passengers climbing and descending the circulation slope 41 and 42.

Preferably, the circulation slopes 41 and 42 are more or less the same length. around 6 to 8 metres, preferably 7 metres. Hence the circulation paths stretch over half the length of the vehicle 1.

As represented in FIG. 2. the upper circulation system 4 is made safe laterally to enable passengers to keep their balance when climbing or descending the upper circulation system 4. The first circulation slope 41 is made safe on one side by the side panel 6 of the vehicle 1, and on the other side by a support partition 44 of the circulation slope 42 as shown in FIGS. 2 and 3. In this way lateral leaning of a passenger is prevented, thus limiting the risk of falls. Still referring to FIGS. 2 and 3. the support partition 44 extends vertically under the second circulation slope 42.

In reference to FIG. 2. the circulation slope 42 is made safe on one side by a vertical separating partition 45 of the upper deck 20 and on the other side by a guard rail 46 to prevent lateral leaning of a passenger and limit the risk of falls. Preferably, a handrail 47 can also be provided on the support partition 44 of the second slope 42 to facilitate movement on the first circulation slope 41, as shown in FIG. 2.

In this example, as represented in FIG. 2. the support partition 44 of the second inclined slope 42 contains at least one space 8 fitted out to receive passengers' luggage, it being advantageous for the said space to be accessible from the first inclined slope 41. In other words the luggage is housed under the second inclined slope 42. Thus the upper circulation system 4 fulfils a dual function of providing access to the upper deck 20 and also housing luggage and thus enabling the number of seats on decks 10 and 20 to be maximized.

Figure 5:
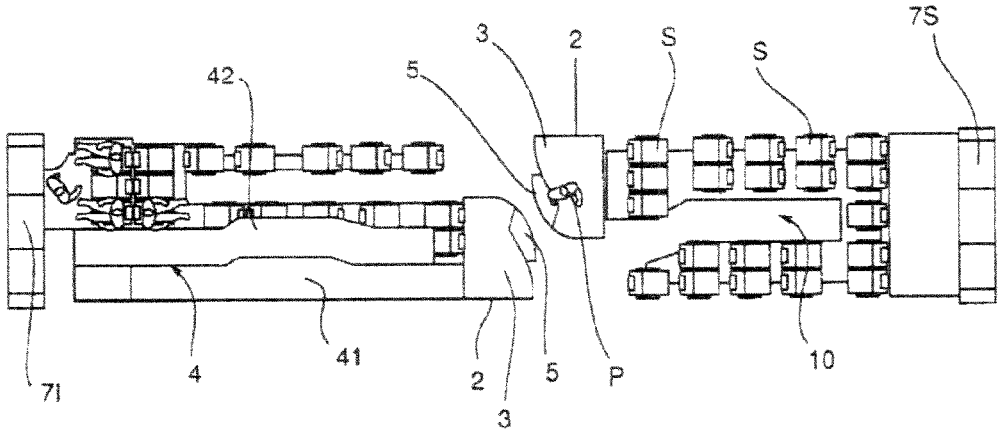
FIG. 5 is a schematic top view of the upper deck of the vehicle in FIG. 4.
Figure 6:
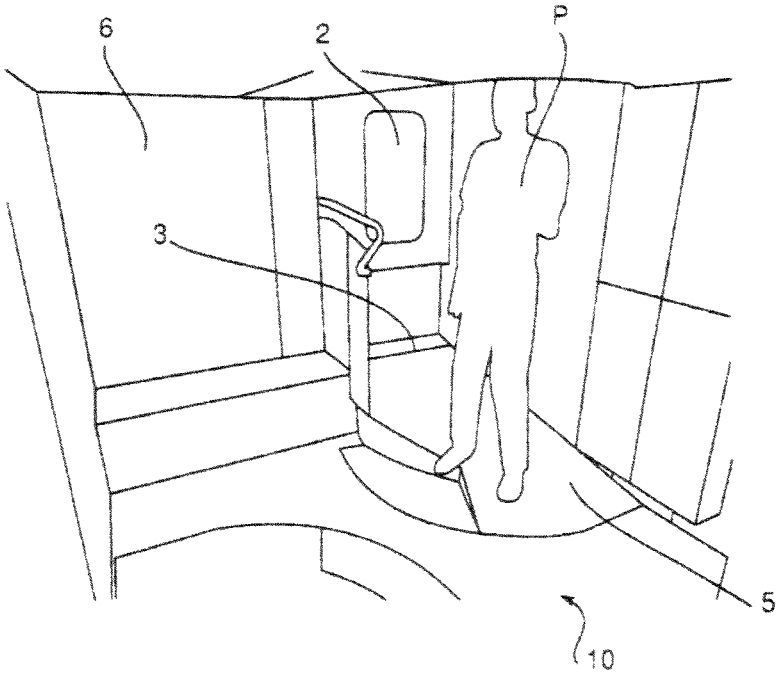
FIG. 6 is a schematic perspective view of a passenger situated on the lower deck of the vehicle in FIG. 5.

In reference to FIGS. 4 to 6, the vehicle 1 has a lower circulation system 5 that joins the access step 3 to the lower deck lower 10, this said deck having a vertical height less than that of the access step 3. In this example, the lower circulation system 5 has a short sloping circulation path, of approximately one metre to reach the lower deck 10. Preferably, the access step 3 may also itself be inclined to reach the lower deck 10 as shown in FIG. 6. The angle of the slope of the lower circulation system 5 is, in this example, between 8% and 15%.

As shown in FIG. 4, the railway rolling stock vehicle 1 according to aspects of the system, apparatus, and method has at each of its longitudinal extremities a communication corridor 7I and 7S with another vehicle 1 to which it is coupled. Henceforth the terms "left" and "right" are defined in relation to FIG. 4 which represents a railway rolling stock vehicle extending lengthways from left to right.

In this example, the vehicle 1 has at its left longitudinal extremity, a first communication corridor 7I from the intermediate landing 43 of the upper circulation system 4. Hence, the first communication corridor 7I is at an intermediate vertical height in relation to the access step 3. At its other right-hand longitudinal extremity, the vehicle one has a second communication corridor 7S from the upper deck 20 as shown in FIG. 4. Hence the second communication corridor 7S is at a higher vertical height in relation to the access step 3. Henceforth the communication corridors 7I and 7S of a railway the vehicle I are called: intermediate communication corridor 7I and top communication corridor 7S.

The orientation of a vehicle 1 is defined henceforth, according to the orientation of its communication corridors 7I and 7S. For example, the vehicle 1 in FIG. 4 has IS orientation as its intermediate communication corridor 7I is situated on the left and its top communication corridor 7S situated on the right. Similarly, a vehicle has an SI orientation if its top communication corridor 7S is situated on the left and its intermediate communication corridor 7I is situated on the right.

When a train is being formed of vehicles 1 according to the system, apparatus, and method, two consecutive vehicles 1 are coupled by their communication corridors 7I and 7S of the same vertical height. For example, in reference to FIG. 8, the vehicle 1 in FIG. 4 with IS orientation is coupled at its left hand end to a vehicle 1 with SI orientation with an intermediate communication corridor 7I at its right-hand end. Similarly, the vehicle 1 in FIG. 4 is coupled at its right hand end to a vehicle 1 with SI orientation having a top communication corridor 7S at its left hand end. In other words, consecutive vehicles in a train have opposite orientations. Such a train advantageously enables anyone, including a person with reduced mobility to access another vehicle easily without using stairs. In the same advantageous manner, all vehicles in a train are identical, simply their orientation during train assembly is different.

Figure 8:
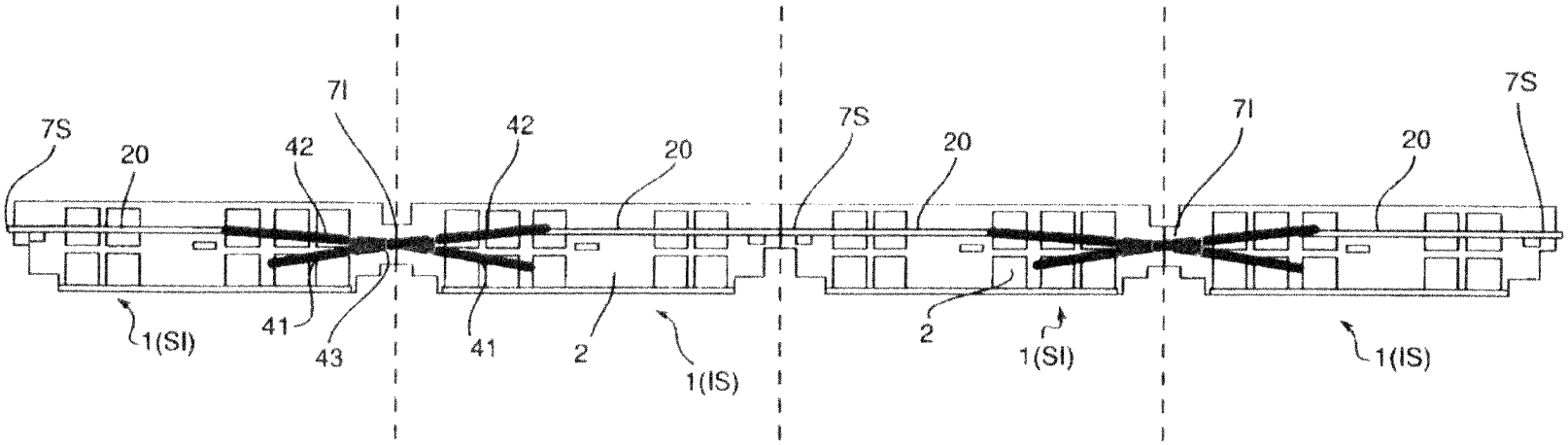
FIG. 8 is a schematic representation of a train comprising several vehicles according to the system, apparatus, and method.

A train containing several vehicles according to the system, apparatus, and method is represented in FIG. 8. For clarity, only the upper circulation paths 4 are shown in FIG. 8. The space available for passenger seats in a railway wagon, according to the system, apparatus, and method is not reduced in relation to a railway wagon using existing technology as each vehicle only has one upper circulation system 4.

Figure 7:
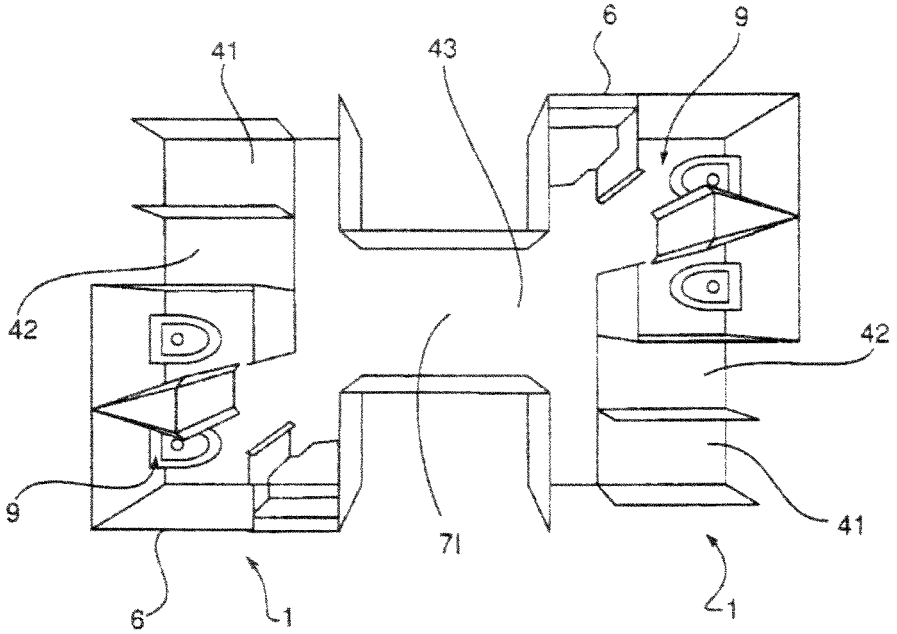
FIG. 7 is a simplified draught of an example of the layout of the extremity of a vehicle with circulation slopes.

The connection of two vehicles 1 by their upper communication corridors 7S is already known and has no effect on the space available for passengers. The connection between two vehicles 1 by their intermediate communication corridors 7I can he used advantageously, for example, for the installation of toilet blocks 9 on the intermediate landing 43 as shown in FIG. 7. In other words, the intermediate landing 43 serves the inclines slopes 41 and 42 of the upper circulation system 4, a toilet block 9 and the intermediate communication corridor 7I to another vehicle.

Railway rolling stock comprising only vehicles 1 according to the system, apparatus, and method has already been presented, but the system, apparatus, and method also applies to railway rolling stock comprising only one vehicle according to the system, apparatus, and method, coupled to vehicles according to prior art with staircases.

An application of the system, apparatus, and method will now be presented for the access of a person P to his/her seat S situated on the upper deck 20 of the vehicle 1. In reference to FIGS. 5 and 6, the person P has entered the vehicle 1 by the access door 2 and is situated on the access step 3. To reach the upper deck 20. the person P descends from the step 3 via the lower circulation system 5 to reach the lower deck 10. He/she then climbs onto the access step 3 of the opposite access door 2 to reach the upper circulation system 4. The passage from one access step 3 to the opposite access step 3 is easy because each access 3 has a lower circulation system 5. If the person P had entered the vehicle 1 by the opposite access door 2. the upper circulation system 4 would have been directly accessible.

In reference to FIG. 2, the person P then climbs the first circulation slope 41 easily and safely using the handrail 47. If the person P has luggage he/she can deposit it in the space 8 provided for this purpose situated in the support partition 44 of the second circulation slope 42. When climbing the circulation system 4, the person P arrives at the intermediate landing 43 which enables him/her to pause in his/her ascension on a flat platform, or for instance, to enter the toilet block 9 (FIG. 7). The person P then simply has to climb the second circulation slope 42 to reach the upper deck 20 before reaching his/her seat S. Access to seat S is easy and produces little anxiety for a person with reduced mobility considering the absence of steps or stairs.

According to a form of execution not represented, the upper circulation system has a lower slope joining the step to the intermediate landing and an inclined circulation staircase connecting the intermediate landing to the upper deck. Hence, a person with reduced mobility can move about between vehicles by circulating on the lower slopes of the said vehicles which are linked at the intermediate landing. The upper deck is only accessible by stairs which take very little space.

According to another form of execution not represented, the upper circulation path has a first lower staircase connecting the step to the intermediate landing and a second upper staircase connecting the intermediate landing to the upper deck. Such staircases are advantageous in comparison with a single staircase according to previous technology of which the steep angle and space occupied are disadvantages. The use of two staircases with gentle slopes and opposite to each other enables the access of persons with reduced mobility while at the same time maximising the useable space in the vehicle for luggage or the installation of toilets.

What is claimed is:

1. A double-decker vehicle for passenger carrying railway rolling stock comprising:

a lower deck and an upper deck located above the lower deck, each deck having a plurality of seats for passengers;

at least one access door with an access step at the lower deck;

a first sloping path having a length connecting the access step to an intermediate landing;

a second sloping path having a length connecting the intermediate landing to the upper deck, wherein two or more seats of the plurality of seats of the lower deck are located adjacent and along the length of the first sloping path; and a free space for technical requirements or services to the passengers, or a space for luggage, situated under the second sloping path and accessible from inside the vehicle.

2. The vehicle according to claim 1, wherein slopes of the first and second sloping paths are opposed.

3. The vehicle according to claim 1, wherein the intermediate landing is situated at a longitudinal extremity of the vehicle.

4. The vehicle according to claim 3, wherein the access step is situated at an extremity of one of the sloping paths.

5. The vehicle according to claim 1, wherein the first and second sloping paths each comprises a slope of between 8% and 15%.

6. The vehicle according to claim 5, wherein the slopes are between 8% and 12%.

7. The vehicle according to claim 1, wherein the lengths of the first and second sloping paths are each between 6 m and 10 m.

8. The vehicle according to claim 1, further comprising at a first longitudinal extremity, an upper communication corridor adapted for access to another vehicle and, at a second longitudinal extremity, an intermediate communication corridor adapted for access to another vehicle.

9. The vehicle according to claim 1, wherein the lower deck and the upper deck each comprises two end walls defining a vehicle length and two sidewalls defining a vehicle width; and wherein the first sloping path and two or more seats of the plurality of seats of the lower deck occupy a section of the vehicle width of the lower deck; and the second sloping path and two or more seats of the plurality of seats of the upper deck occupy a section of the vehicle width of the upper deck.

10. The vehicle according to claim 1, wherein the at least one access door is located at an outer wall of the vehicle, and the first sloping path is located adjacent the outer wall of the vehicle.

11. A double-decker vehicle for passenger carrying railway rolling stock comprising:

a lower deck and an upper deck located above the lower deck, each deck having a plurality of seats for passengers;

at least one access door with an access step at the lower deck;

a first sloping path having a length connecting the access step to an intermediate landing;

a second sloping path having a length connecting the intermediate landing to the upper deck, wherein two or more seats of the plurality of seats of the lower deck are located adjacent and along the length of the first sloping path;

a separating portion extending vertically from the second sloping path to separate two or more seats of the plurality of seats of the upper deck from the second sloping path; and wherein the two or more seats of the plurality of seats of the lower deck are located beneath the second sloping path.

12. A double-decker vehicle for passenger carrying railway rolling stock comprising:

a lower deck and an upper deck located above the lower deck, each deck having a plurality of seats for passengers;

at least one access door with an access step at the lower deck;

a first sloping path having a length connecting the access step to an intermediate landing;

a second sloping path having a length connecting the intermediate landing to the upper deck, wherein two or more seats of the plurality of seats of the lower deck are located adjacent and along the length of the first sloping path;

wherein the two or more seats of the plurality of seats of the lower deck are located beneath the second sloping path; and wherein at least one of the first sloping path and the second sloping path has a first width and a larger second width defining a passing section to facilitate passing of passengers climbing and descending the sloping path.

13. A railway rolling stock comprising at least one left-handed vehicle and at least one right-handed vehicle, the left-handed vehicle and right-handed vehicle each comprising:

a lower deck and an upper deck located above the lower deck, each deck extending from a forward end to a rear end of the vehicle, and having a plurality of seats for passengers;

an intermediate landing between the lower deck and the upper deck;

an access step inside an entrance to the vehicle, the entrance being located on a side of the vehicle between the forward end and the rear end;

a first sloping path having a length connecting the lower deck to the intermediate landing; and a second sloping path having a length connecting the intermediate landing to the upper deck; and wherein two or more of the plurality of seats of the lower deck are located adjacent and along the length of the first sloping path, the left-handed vehicle further comprises a first communication corridor from the intermediate landing at the forward end of the vehicle, and a second communication corridor from the upper deck at the rear end of the vehicle; the right-handed vehicle further comprises a first communication corridor from the upper deck at the forward end of the vehicle, and a second communication corridor from the intermediate landing at the rear end of the vehicle; the left-handed vehicle is connected to a right-handed vehicle, with the first communication corridor of either vehicle connected to a second communication corridor of an adjacent vehicle, and wherein a space is defined under the second sloping path, and accessible from inside the vehicle.

14. The railway rolling stock of claim 13, further comprising at least one toilet block at the intermediate landings of the left-handed vehicle and right handed vehicle.

15. The railway rolling stock of claim 13, wherein the two or more seats of the plurality of seats of the lower deck are located beneath the second sloping path.

16. The railway rolling stock of claim 15, wherein at least one of the first sloping path and the second section path has a first width and a larger second width defining a passing section to facilitate passing of passengers climbing and descending the sloping path.

17. The railway rolling stock of claim 13, wherein the lower deck and the upper deck each comprises two end walls defining a vehicle length and two sidewalls defining a vehicle width; and wherein the first sloping path and the two or more seats of the plurality of seats on the lower deck occupy a section of the vehicle width of the lower deck; and the second sloping path and two or more seats of the plurality of seats on the upper deck occupy a section of the vehicle width of the upper deck.

* * * * *